US007121057B1

(12) United States Patent
Pilcher

(10) Patent No.: US 7,121,057 B1
(45) Date of Patent: Oct. 17, 2006

(54) CONTOUR ILLUSION ROOF TILE

(76) Inventor: Joseph Mitchell Pilcher, 1616 Park Pl., Wichita, KS (US) 67203

( * ) Notice: Subject to any disclaimer, the term of this patent is extended or adjusted under 35 U.S.C. 154(b) by 0 days.

(21) Appl. No.: 10/961,759

(22) Filed: Oct. 8, 2004

Related U.S. Application Data

(63) Continuation-in-part of application No. 10/403,746, filed on Mar. 31, 2003, which is a continuation-in-part of application No. 10/228,768, filed on Aug. 27, 2002, now abandoned, which is a continuation of application No. 09/791,449, filed on Feb. 22, 2001, now Pat. No. 6,539,683.

(60) Provisional application No. 60/315,115, filed on Aug. 27, 2001, provisional application No. 60/184,309, filed on Feb. 22, 2000.

(51) Int. Cl.
*E04D 1/00* (2006.01)

(52) U.S. Cl. ..... 52/518; 52/528; 52/537; 52/555; 52/314

(58) Field of Classification Search ..... 52/386, 52/385, 90.1, 94, 95, 96, 518, 521, 528, 535, 52/537, 540, 554, 555, 556, 314; D25/96, D25/80, 141, 139; 425/134, 218, 289; 428/184, 428/185, 141, 156, 172
See application file for complete search history.

(56) References Cited

U.S. PATENT DOCUMENTS

| | | | | | |
|---|---|---|---|---|---|
| 3,091,898 | A * | 6/1963 | Fasold | 52/537 |
| 3,943,677 | A * | 3/1976 | Carothers | 52/309.4 |
| 4,251,967 | A * | 2/1981 | Hoofe, III | 52/535 |
| 5,131,200 | A * | 7/1992 | McKinnon | 52/536 |
| 6,164,034 | A * | 12/2000 | Roetheli et al. | 52/560 |
| 6,282,858 | B1 * | 9/2001 | Swick | 52/533 |
| D473,327 | S * | 4/2003 | Lynch | D25/141 |

* cited by examiner

*Primary Examiner*—Carl D. Friedman
*Assistant Examiner*—Chi Q. Nguyen
(74) *Attorney, Agent, or Firm*—Robert O. Blinn

(57) ABSTRACT

The roof tile system of the present invention includes parallel patterns of channels or features which when viewed in a large pattern of identical tiles create the illusion of a surface made using a costly three dimensional roofing material such as Spanish tile. The patterns of channels or features may also function to direct the flow of water in a manner that is consistent with the apparent contour of the surface. The patterns of channels or features may also be arranged to direct the flow of rain water from a first area of a roof to a second area of a roof. An added water directing feature in the tiles of a bottom course of tiles can be used to direct rain water into an enclosed rain gutter.

5 Claims, 8 Drawing Sheets

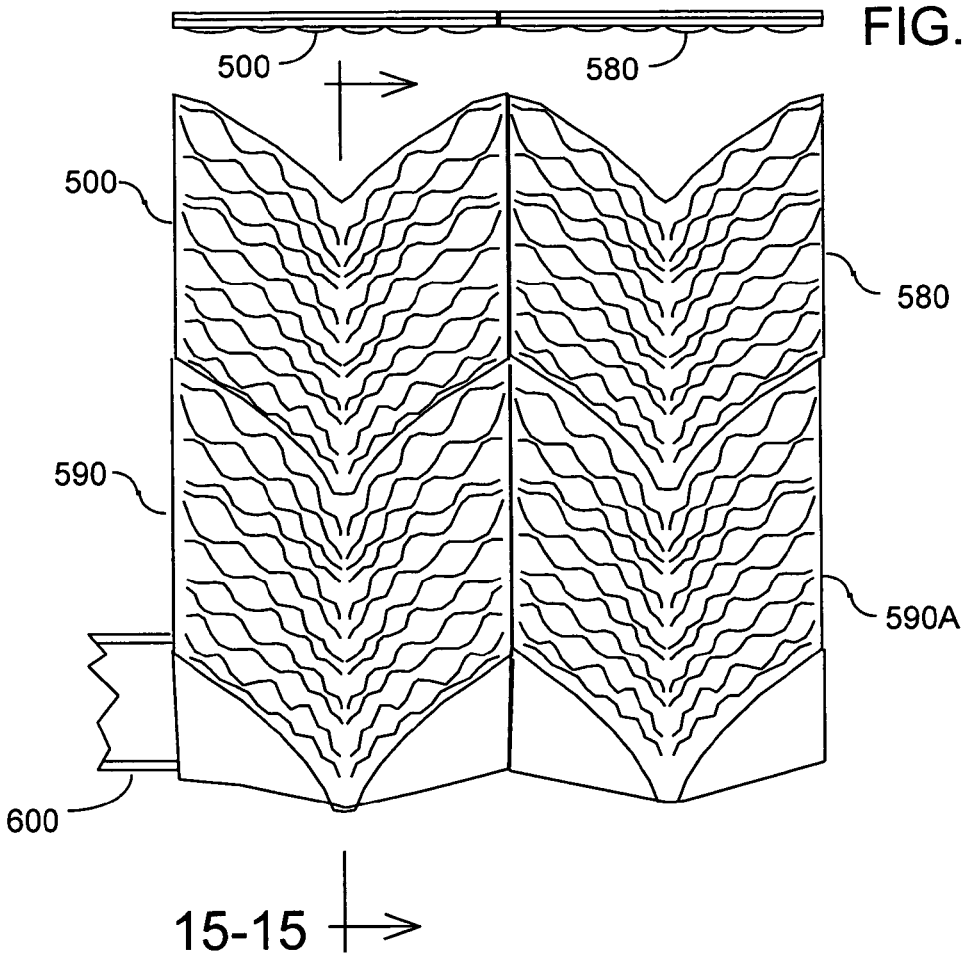
FIG. 14A
FIG. 14
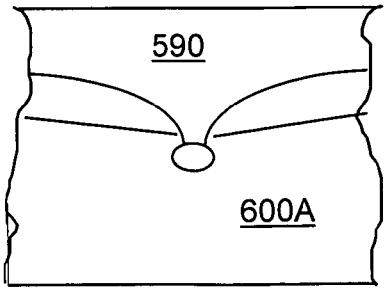
FIG. 15A
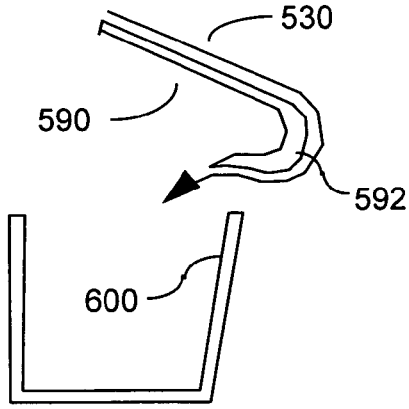
FIG. 15

CONTOUR ILLUSION ROOF TILE

CROSS REFERENCES TO RELATED APPLICATIONS

This application is a continuation in part of application Ser. No. 10/228,768 filed Aug. 27, 2002 now abandoned. This application is also a continuation in part of application Ser. No. 10/403,746 filed Mar. 31, 2003. Application Ser. No. 10/403,746 is a continuation of application Ser. No. 09/791,449 filed Feb. 22, 2001 which has issued as U.S. Pat. No. 6,539,683. Application Ser. No. 09/791,449 claimed the benefit of Provisional U.S. Application Ser. No. 60/184,309 filed Feb. 22, 2000.

Application Ser. No. 10/228,768 claimed the benefit of U.S. Provisional Patent Application No. 60/315,115 filed Aug. 27, 2001.

FIELD OF THE INVENTION

This invention relates to substantially flat roof tiles having textured surface patterns which can direct the flow of rain water and which can present an illusion of a contoured surface.

BACKGROUND OF THE INVENTION

Expensive roofing materials are often curved or contoured and generally provide an esthetically pleasing, contoured appearance. Manufacturers of relatively inexpensive, composite roofing shingles have, in the past, shaded adjacent composite shingles in a contrasting manner to create the impression of a uneven, textured surface. However, the prior art does not teach substantially flat roofing shingles or tiles that present the appearance of a regular, contoured appearance similar to that which is created by Spanish tile or such other varied contoured arrangements. Still further, contoured Spanish tile requires increase amounts of material per unit area of roof. This adds to roofing loads. Thus, it would be desirable to have an inexpensive tile system that is generally flat but which has the appearance of a contoured surface.

BRIEF DESCRIPTION OF THE INVENTION

In an embodiment of the present invention, the aforementioned problems are addressed by providing a roofing tile that is substantially flat yet presents the illusion of a highly contoured surface when arranged in a pattern on a roof surface. The aforementioned problems are also addressed by providing a tile which will, when arranged in a pattern, direct the flow of rain water in a manner that is consistent with the contour that appears to be present in the pattern of tiles. Another advantageous aspect of the present invention is to provide roofing tiles with undulating cross sections for greater strength and resistance to damage. Another advantageous aspect of the invention is that roofing tiles with patterns of raised areas can be shaded with light colors on surfaces oriented at high angles to reflect summer sunlight and which can also be shaded with darker colors on surfaces oriented at lower angles to present dark shaded surfaces to a ground level observer and to absorb low angled sunlight during winter months.

The above mentioned features are obtained in an improved type of roofing tile which is generally flat but which is textured by features in its surface that are organized in a pattern that follows a series of generally parallel curves. The textured features are shaped and patterned to present the illusion of a contoured, three dimensional surface such as might be presented by a Spanish roof tile having a semi-circular cross section. This textured pattern not only presents an illusion of contour and depth, it also can direct the flow of rain water on the surface of the tile in a manner consistent with the apparent contour of the tile, so that the depth of flow of rain water on the surface of the generally flat tile concentrates and increases in depth where the surface of the tile appears to be lower and deeper.

Several embodiments of the contour illusion roof tile are possible. Alternating raised areas and channels can be arranged that curve across the surface of the roof tile. A system of tiles can include two types of tiles presenting the illusion of cylindrical convex and concave surfaces as shown in FIG. 5. A system of tiles can have one type of tile that presents the illusion of a pattern of convex surfaces as shown in FIG. 1 and FIG. 9. The textured surface of a tile can employ a pattern of oval or elliptical shaped raised areas with progressively varying angles of orientation and eccentricities to present the illusion of a regularly contoured surface as shown in FIG. 11. However, the pattern shown in FIG. 11, while presenting a illusion of being convex, will not direct the flow of water toward the center of the tile. The textured surface of a tile can also employ a pattern of wave shaped forms as shown in FIG. 13. Such a pattern will direct the flow of rain water toward the center of the tile.

The wave shaped forms shown in FIG. 13 can be altered to progressively decrease in size toward the center of the tile to present the illusion of being convex as is shown in FIGS. 13D, 13E, 13F and 13G. The sine wave feature can be shaped to decrease in period and increase in amplitude across a tile surface to present the illusion of a surface that slopes down from an area having a texture comprised of wave features of low amplitude and a long period (or long wave length) to an apparently lower area having a texture comprised of wave features of greater amplitude and a short period.

The textured surfaces described above present significant advantages. They can be manipulated to present the illusion of contour as well as to control the flow of rain water on a roof tile surface. Textured surfaces can give a roof tile increased durability and strength and can provide a surface that is easier and safer for a workman to walk on. Apparent or illusional contours can be presented that would only be possible with tiles that actually have curved surfaces. Shading can be applied to a textured surface in such a way that high angled summer sun light can be reflected while dark shaded surfaces are presented to low angled winter sunlight and observers at street level. All of these and other advantages can be obtained by applying intelligently designed textured surfaces to roof tiles.

The parallel pattern of features can also be configured in a tile to be used in a bottom course of tiles to concentrate water in a stream which can then be directed to flow around an inwardly turned feature so that the stream of water will substantially reverse its direction and flow back into a rain gutter that is covered by the bottom course of tiles. In such a system where a rain gutter is covered by a bottom course of tiles, the covered gutter would receive water but not gutter obstructing debris.

BRIEF DESCRIPTION OF THE DRAWINGS

FIG. 14 is a plan view of a pattern of four roof tiles of the type shown in FIG. 13.

FIG. 14A is an end view of a roof tile of FIG. 14 showing that the roof tiles of FIG. 14 are generally flat.

FIG. 15 is a cross section side view of one of the four roof tiles of FIG. 14 taken from plane 15—15 of FIG. 14.

FIG. 15A is an end view of the roof tile and gutter shown in FIG. 15.

FIG. 16B is a cross section view of two roof tiles of FIG. 16 taken from plane B—B of FIG. 16.

DETAILED DESCRIPTION

Figure 1A:
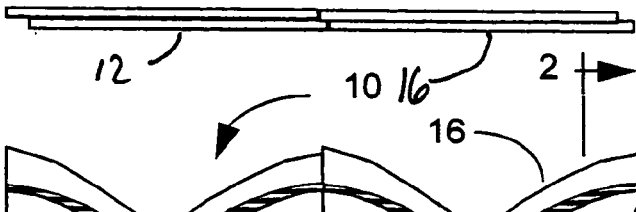
FIG. 1 is a plan view of a pattern of three channeled roof tiles.
Figure 1:
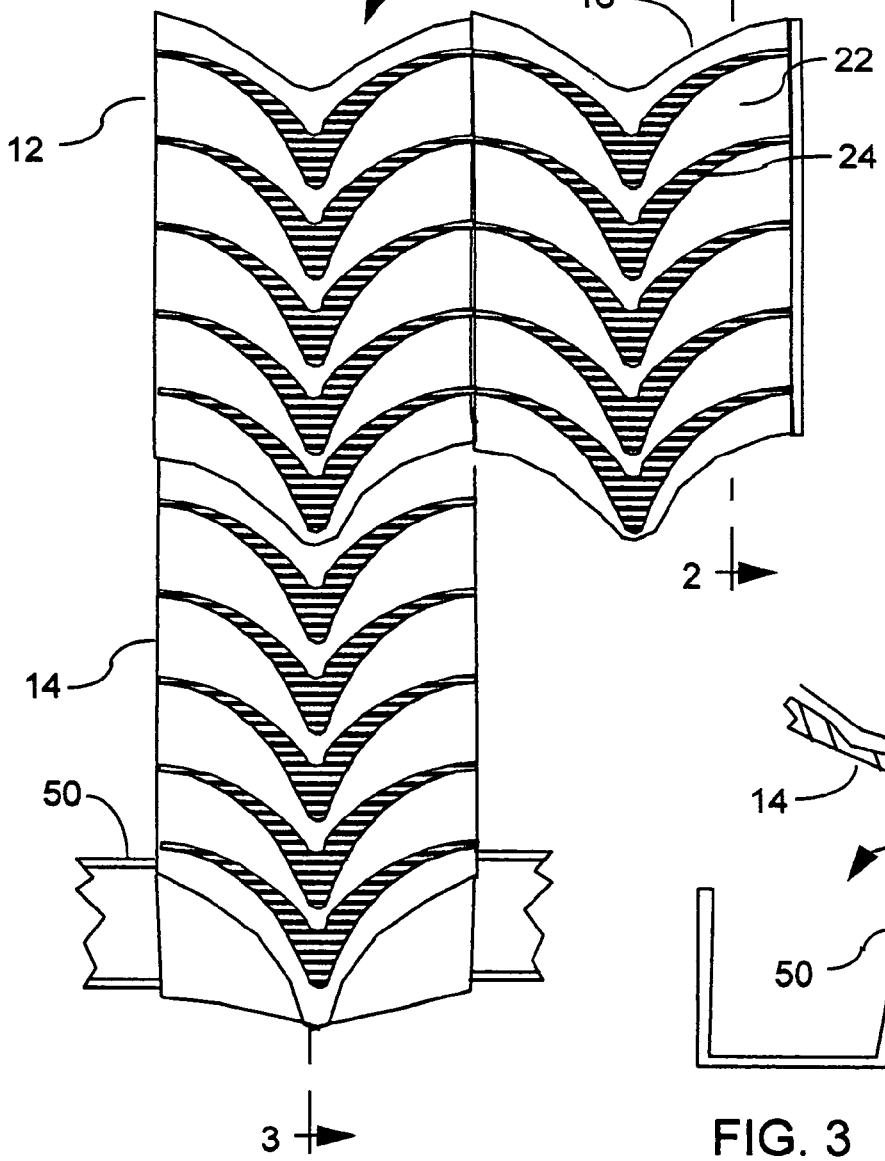

Referring to the drawings, FIG. 1 illustrates a pattern of tiles including a first tile 12, a second tile 14 and a third tile 16. On a roof system, tile 12 would be placed above tile 14. A rain gutter 50 is located under the bottom edge of tile 14. Tile 14 is one of a bottom course of substantially identical tiles that would cover rain gutter 50. Tiles 12 and 14 could also be fashioned together as one piece of material and yet also fashioned to appear as separate tiles. Moreover, strips of thin gage material could be fashioned to extend from the ridge of a roof to the eave edge and yet also be fashioned to look like a column of tiles.

As is shown in FIG. 1, third tile 16, like first tile 12 and second tile 14, includes flat zones 22 and channeled zones 24. In FIG. 1, channeled zones are represented by the shaded areas. These channeled zones increase in width toward the center of each tile. In the alternative, channeled zones may follow a pattern of straight lines (instead of curved lines) toward the center of the tile. This would present the illusion of a surface having alternating sharp peaks and grooves. The channeled zones may also decrease in width and depth toward the center of a tile. However, they should be generally configured to direct rain water toward the center of the tiles.

Figure 2:
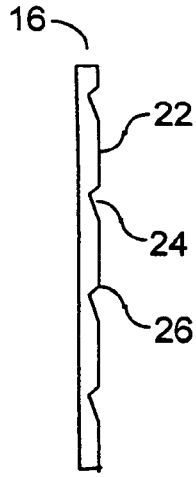
FIG. 2 is a cross section side view of one of the three channeled roof tiles of FIG. 1 taken from plane 2—2 of FIG. 1.

FIG. 2 is a cross sectional view of tile 16 taken from plane 2—2 of FIG. 1. As can be seen in FIG. 2, channeled zones 24 have a pronounced edge at the top of the channel with a more gradual profile at the bottom of the channel. Although the channeled zones as shown in FIG. 2, appear to have a substantial depth, substantially the same water directing capability can be accomplished with very shallow channels. With a combination of shading and shallow channels, it would be possible to accomplish the visual illusion of a curved surface. The visual illusion of a surface made from curved tiles can also be accomplished using only shaded zones. However, the flow of water can not be directed with shaded zones and must be accomplished with actual surface features or at least alternating zones having varying affinity for water.

Figure 4:
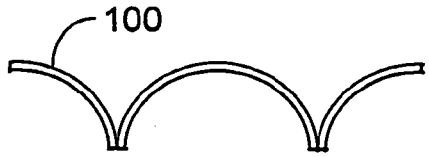
FIG. 4 is a cross sectional illustration of the apparent contour of the roof tiles of FIG. 1.

FIG. 4 provides an illustration of the apparent shape of tiles 12 and 16 as seen from a distance in a pattern of tiles. Although tiles 12 and 16 are substantially flat, because of channeled zones 24 and the shadows that are created by those channeled zones, tiles 12 and 16 will appear to be curved when placed in a pattern of tiles having the same pattern of channels.

Figure 3:
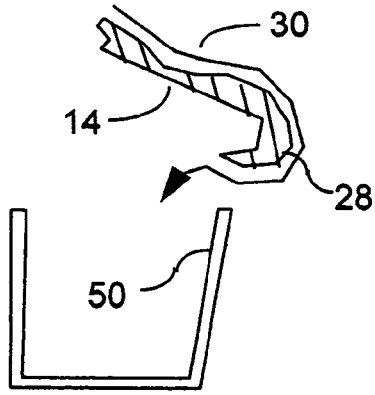
FIG. 3 is a cross section side view taken from plane 3—3 of FIG. 1

FIG. 3 is a side view of tile 14 as it covers a rain gutter 50. At the lower end of tile 14 is a beak 28 which curves around under tile 14. A flow of rain water 30 which has been concentrated to the center of tile 14 by the channels in tile 14 (as described above), follows the curve of beak 28, separates from beak 28 and flows into the center of gutter 50. As can be seen in FIG. 1 and FIG. 3, gutter 50 is completely covered by tile 14 so that no falling debris can fall into and obstruct gutter 50. With this system, only rain water flowing off the bottom row of tiles such as tile 14 can enter rain gutter 50.

Figure 5:
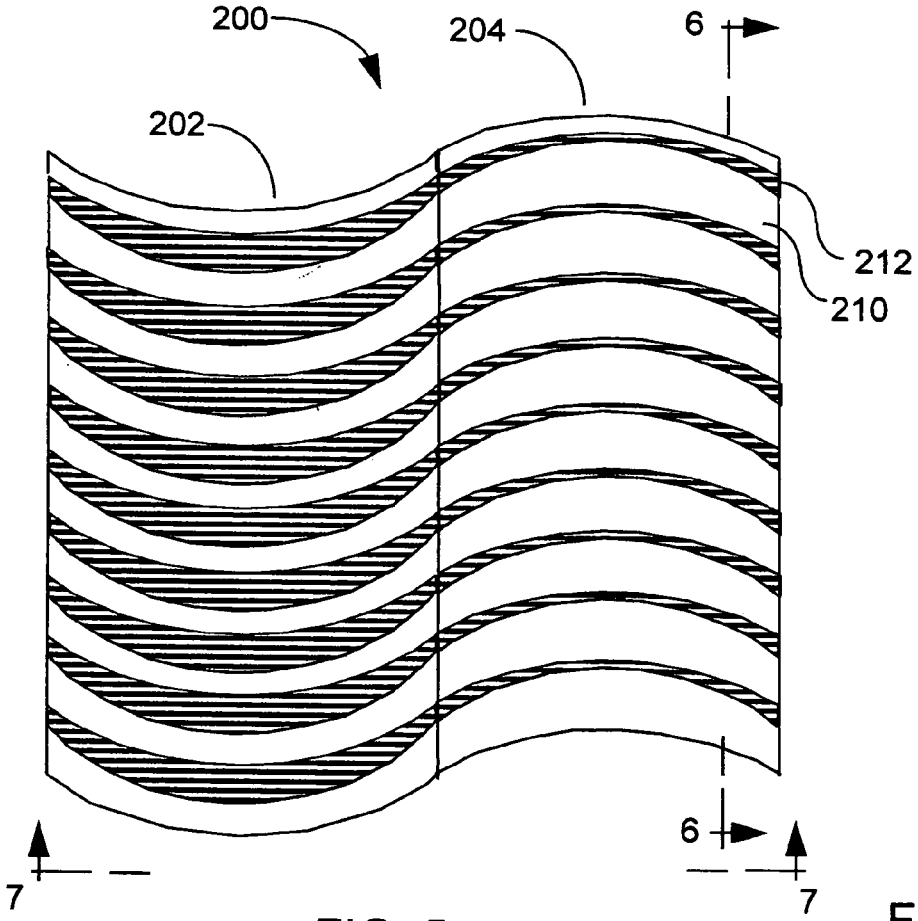
FIG. 5 is a plan view of a pattern of two channeled roof tiles.
Figure 6:
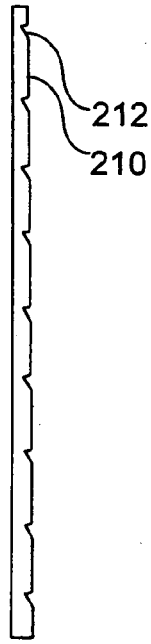
FIG. 6 is a cross section side view of one of the two channeled roof tiles of FIG. 5 taken from plane 6—6 of FIG. 5.

FIG. 5 is an alternate embodiment 200 of the present invention. FIG. 5 illustrates tiles 202 and 204. FIG. 6 is taken from plane 6—6 of FIG. 5. FIG. 6 illustrates flat zones 210 and channeled zones 212 of tile 204. As with FIG. 1, in FIG. 5, channeled zones 212 are indicated by shaded areas.

Figure 8:
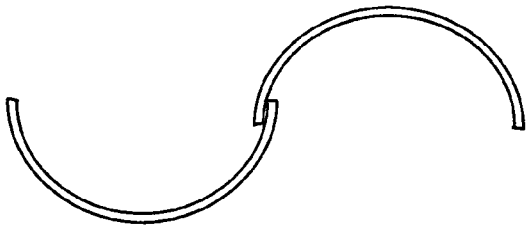
FIG. 8 is a cross sectional illustration of the apparent contour of the roof tiles of FIG. 5.

The channeled areas become progressively wider toward the edges of tile 204 as well as wider toward the center of tile 202. FIG. 8 provides an illustration of the apparent contour of tiles 202 and 204 when they are viewed in a pattern of compatible tiles. This apparent contour is that of "Spanish tile" which consists of alternating concave and convex tiles which efficiently direct the flow of water in the concave tiles.

Figure 7:
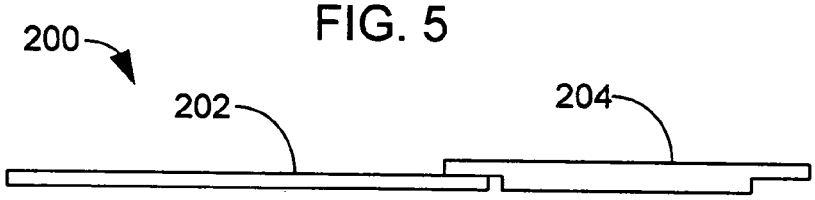
FIG. 7 is a cross section side view of one of both channeled roof tiles of FIG. 5 taken from plane 7—7 of FIG. 5.

FIG. 7 provides a lower end view of tiles 202 and 204 showing how tile 202 may overlap with tile 204. With this arrangement, flowing water would follow the channeling away from the center of tile 204 and toward the center of tile 202 and then down tile 202 to the next tile as water flows down from the roof. Water directing features such a beak 28 shown in FIG. 3 might be used in a bottom course of tiles to direct water into a protected rain gutter.

Aside from the curved channel configurations described above, any one of a number of channel configurations may be selected to provide the illusion of a surface that has three dimensional depth as well as provide a means to control and direct the flow of rain water. Costs are reduced by using flat materials as opposed to materials that actually do have three dimensional shapes. Flat tiles and tiles may be attached to roof surfaces in conventional ways. They require less material per unit area and are therefore lighter.

Figure 9:
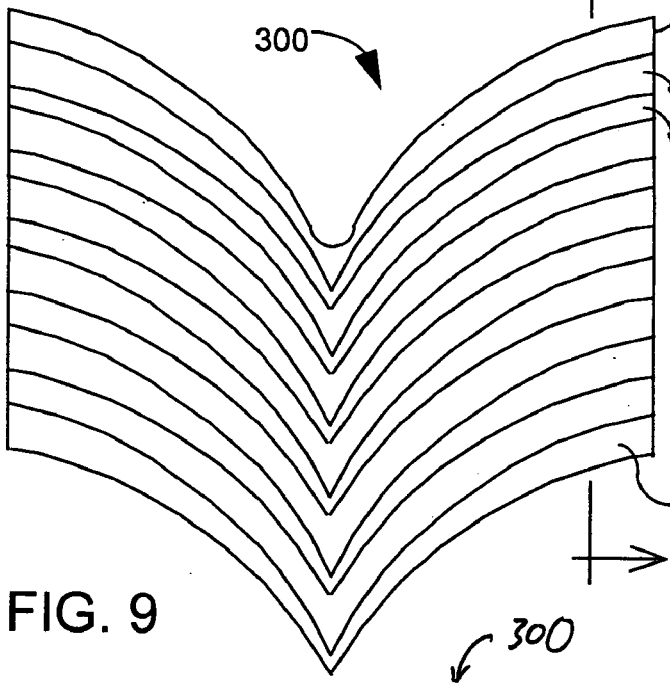
FIG. 9 is a plan view of a roof tile with a surface having a pattern of curved channels and raised areas.
Figure 10:
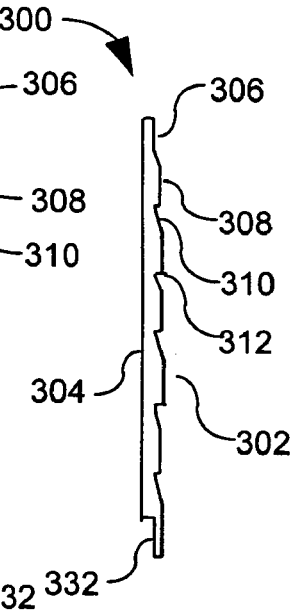
FIG. 10 is a cross sectional view taken from plane 10—10 of FIG. 9.
Figure 9A:
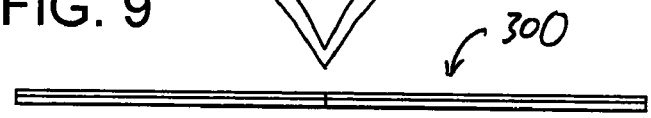
FIG. 9A is an end view of a roof tile of FIG. 9 showing that the roof tile of FIG. 9 is generally flat.

FIG. 9 illustrates tile 300 which is very similar to the tiles 12 and 16 shown in FIG. 1. FIG. 10 provides a cross section view of tile 300 taken from plane 10—10 of FIG. 9. Tile 300 includes a top surface 302 and a bottom surface 304, raised zones 308, channeled zones 310, an upper edge 306 and a lower edge 332. As can be seen in FIG. 9, top surface 302 has a parallel curved pattern of alternating raised zones 308 and channeled zones 310. The lower boundary of each raised zone 308 terminates in an edge 308A. Upper edge 306 is shaped to be received by a lower edge like lower edge 332 such that a first course of tiles on a roof surface can overlap a corresponding second course of tiles installed below the first course of tiles.

Figure 11:
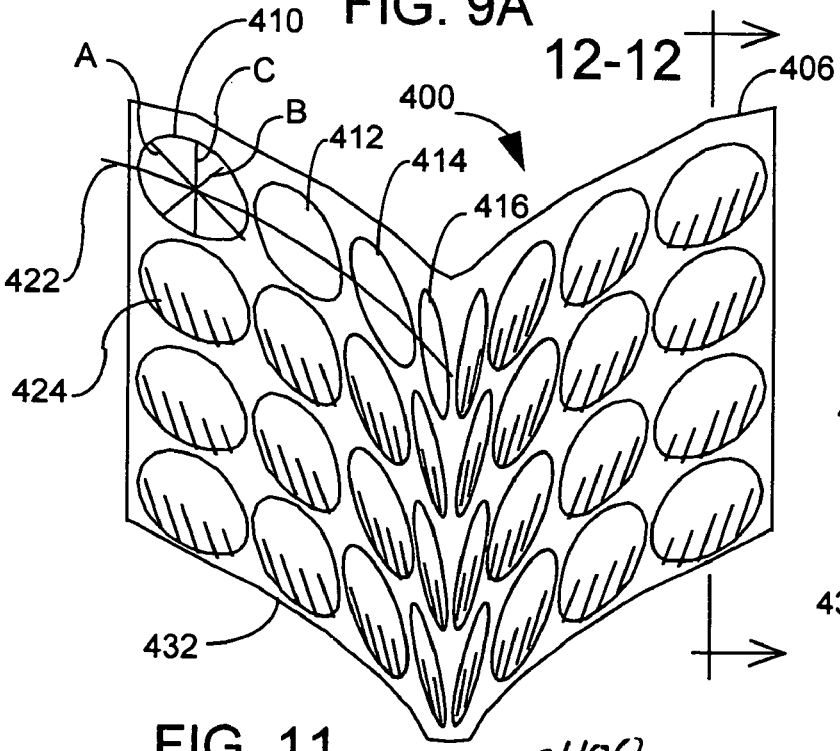
FIG. 11 is a plan view of a roof tile with a surface having a textured pattern of raised oval shaped areas.

FIG. 11 illustrates tile 400 which is similar to the tile 300 shown in FIG. 9, except tile 400 employs a pattern of oval shaped raised areas 410, 412, 414 and 416. The oval shaped raised areas of tile 400 are positioned so that their centers are located on a pattern of parallel curves such as curve 422. Each oval shaped area, such as oval shaped area 410 can be considered as having a major axis A and a minor axis B. The eccentricity of each oval shaped area is defined by the ratio of the length of major axis A to the length of minor axis B. The pattern of oval shaped areas is generated by progressively rotating the orientation of each successive oval centered on curve 422 to an increasingly vertical orientation such that major axis A is more vertical and minor axis B is more horizontal and also so that the eccentricity of each successive oval increases while the length of major axis A remains substantially constant. A pattern of oval shaped areas positioned on a curve such as curve 422 can be repeated on the surface of tile 400 to define the pattern shown in FIG. 11. Tile 400 will present an illusion of having a contoured surface. However, the pattern of oval shaped areas of tile 400 will not direct a flow water toward the center of the tile when it is placed in the position shown in FIG. 11.

A pattern of oval shaped areas as shown in FIG. 11 can be thought of as a pattern of regular shapes such as ellipses which change in orientation and eccentricity across the surface of the tile in a way that is consistent with the desired apparent contour. The shapes and orientations of ellipses, for example, could be understood as similar to the shapes and orientations that circle shaped raised areas having constant spacing, size and eccentricity would appear to have if arranged on the surface of a cylindrical Spanish tile and viewed from the direction of an observer looking at a roof. The textured surfaces presented here can be designed to create the same visual impression as a regularly curved surface. The visual effect is one that presents the appearance of regularly repetitive contours where only basically flat roof tiles are used. Similarly, texturing could be applied to tiles that are only slightly contoured or three dimensional such as a low profile Spanish tile. The texturing of such a low profile tile will greatly increase the perception of contour or depth. This effect occurs because of the shadows that occur on the surface of the tiles. Shading could be applied to a flat surface using a painted pattern, which might work for a motion picture film set where the angle of light is controlled, but on a roof, a pattern of the invention tiles use textures which generate a multitude of shadows, regardless of the angle of the sun, which are consistent with the desired illusional contour. The inventor believes that elliptical regularly shaped areas work best because they are smooth and continuous and therefore cause smooth, continuous and natural shading effects. However, other geometrical shapes could be used in lieu of ellipses in a textured pattern.

Figure 12:
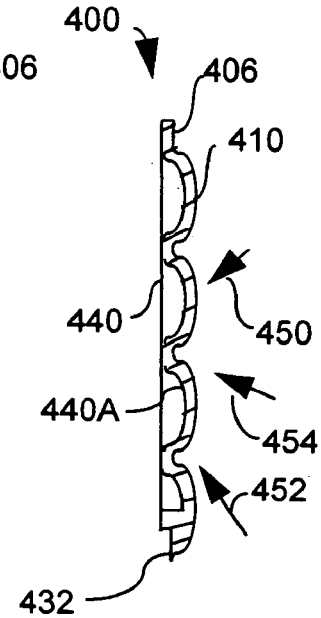
FIG. 12 is a cross sectional view taken from plane 12—12 of FIG. 11.
Figure 11A:
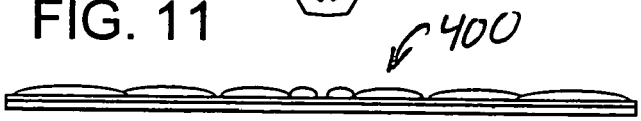
FIG. 11A is an end view of a roof tile of FIG. 11 showing that the roof tile of FIG. 11 is generally flat.

FIG. 12 provides a cross section of tile 400 taken from plane 12—12 of FIG. 11. As can be seen in FIG. 12, the surfaces of the raised oval shaped areas are curved and have elliptical or oval shaped profiles. Upper edge 406 of tile 400 is shaped to be received by lower edge 432 of the next course of tiles. Lower surface 440 may be flat but would preferably include parallel surfaces 440A which are offset from top surface 410. A tile of generally constant thickness as shown in FIG. 12 could be fashioned from less material, would weigh less and thus reduce roof loading and might be stronger than a tile with a flat lower surface.

An additional aspect can be added to tile 400. Portions of the raised oval areas below curve 422 can be given a dark finish as shown with shaded zones 424. (The raised oval zones of the upper left row in FIG. 11 are not shown shaded for clarity of illustration.) This shading provides an important advantage for a roof having a pattern of such shaded tiles. During summer months, such tiles will receive sunlight generally from the direction indicated by vector 450 of FIG. 12 while persons observing the roof will observe the roof surface generally from the direction indicated by vector 452 shown in FIG. 12. The resulting effect is that a roof comprised of a pattern of such tiles having shaded zones 424 will tend to reflect sunlight during summer months while presenting an esthetically pleasing dark surface to observers. During winter months, such a pattern of tiles would present a darker and more heat absorbing surface to sunlight from the direction generally indicated by vector 454 of FIG. 12.

Figure 13:
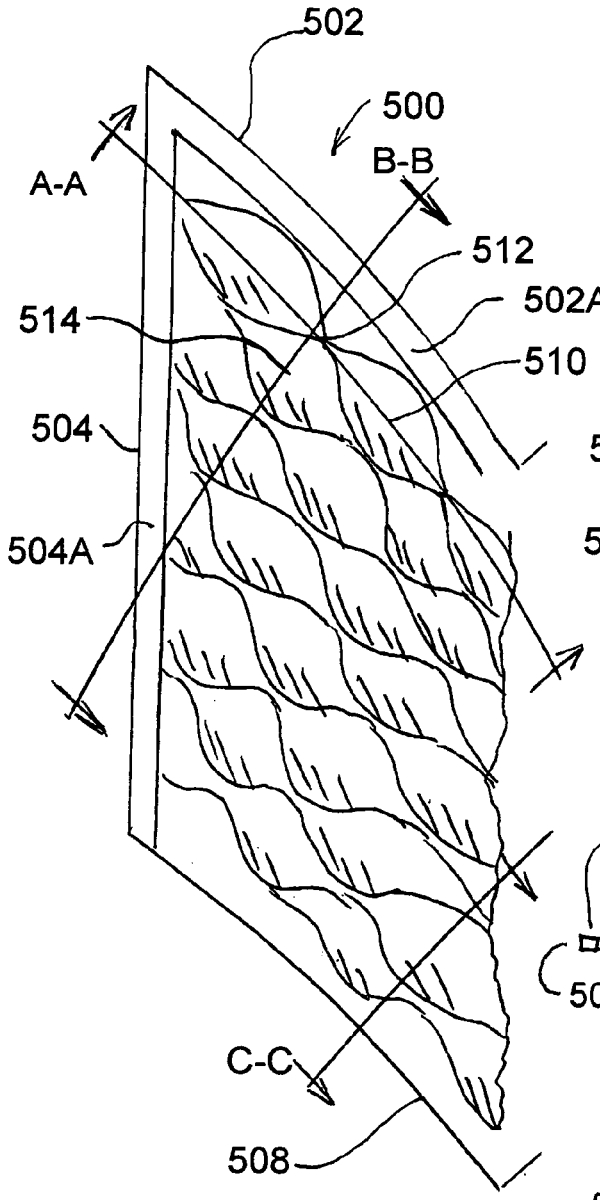
FIG. 13 is a plan view of a roof tile with a surface having a textured pattern of wave shaped areas.

FIG. 13 illustrates tile 500 which is similar to the tile 400 shown in FIG. 11, except tile 500 has an undulating surface which is characterized by three dimensional sine waves. The shape of this surface can be best understood from FIGS. 13A and 13B which are taken from surfaces A—A and B—B which are indicated in FIG. 13. The sine wave shaped surface of tile 500 can be arranged with progressively narrower and shorter period wave features toward the center of tile 500. Moreover, the slope of the curve indicated by surface A—A is configured to have a greater slope toward the center of tile 500. A pattern of wave features that progressively narrow and decrease in period and which are arranged on curves that increase in slope toward the center of the tile presents the illusion that tile 500 is sloped toward the center of the tile. A pattern of such tiles will have a repeating contoured appearance. Still further, the pattern illustrated in FIGS. 13, 13A and 13B will direct the flow of rain water toward the center of tile 500. Flattened edges 502A and 504A and raised lower edge 508A shown in FIG. 13C make it possible to assemble patterns of tiles such as tile 500 such that the pattern of tiles can shed rain water when arranged on a roof surface.

Figure 13A:
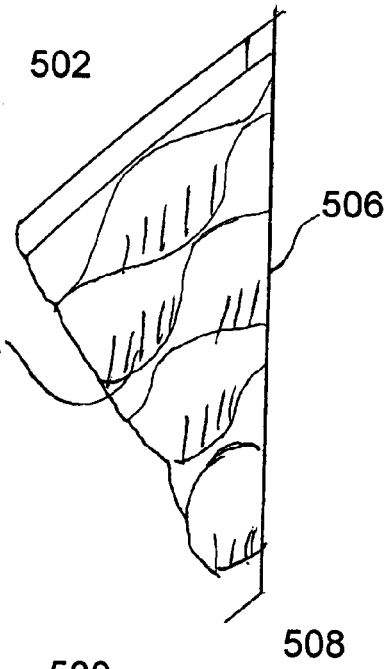
FIG. 13A is a cross sectional view taken from surface A—A of FIG. 13.
Figure 13A:
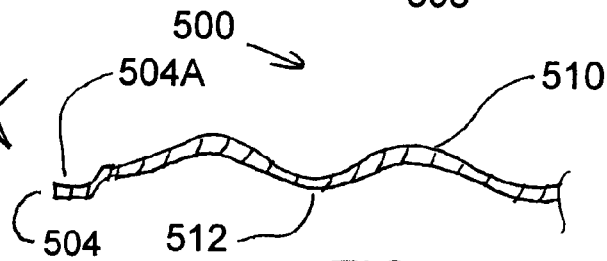
Figure 13B:
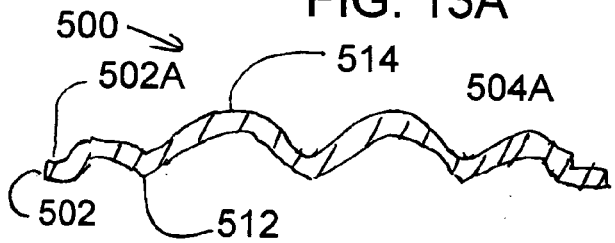
FIG. 13B is a cross sectional view taken from surface B—B of FIG. 13.

FIGS. 13, 13A and 13B show how the surface of tile 500 varies between crests such as crests 510 and 514 and valleys such as valley 512 in two directions. In the direction indicated by surface A—A as shown in FIG. 13A, crests and valley cross sections follow a sine wave pattern. In the direction indicated by surfaces B—B and C—C, crests transition into narrow valleys having a grove shape and therefore do not follow a smooth sine wave profile. This configuration of grooves can be best seen in FIG. 13 where these groves are represented by a meshed sinusoidal pattern. A surface pattern that is inverted from that shown in FIGS. 13, 13A and 13B, that is, having concave features instead of convex features, will have the same basic appearance and will direct rain water in the same manner.

Figure 13C:
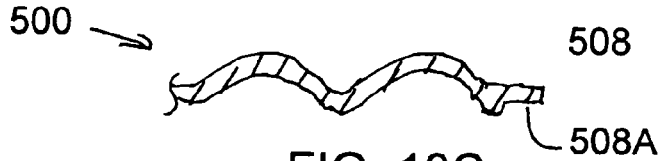
FIG. 13C is a cross sectional view taken from surface C—C of FIG. 13.
Figure 13D:
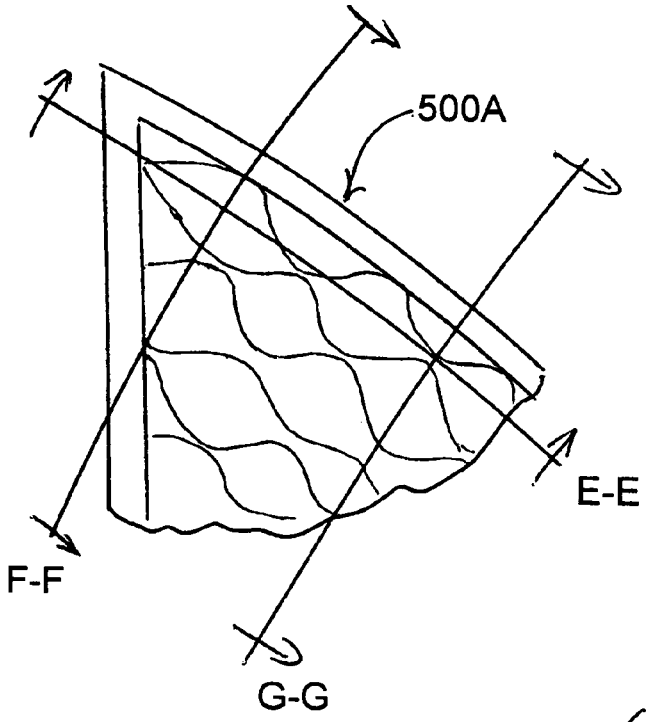
FIG. 13D is a plan view of a roof tile with a surface having a textured pattern of wave shaped areas that vary in amplitude and period.
Figure 13E:
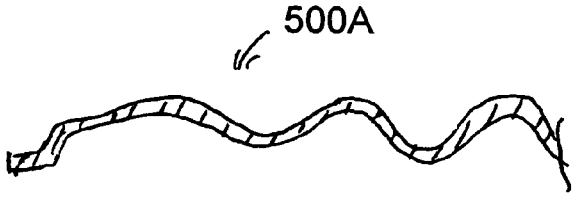
FIG. 13E is a cross sectional view taken from surface E—E of FIG. 13D.
Figure 13F:
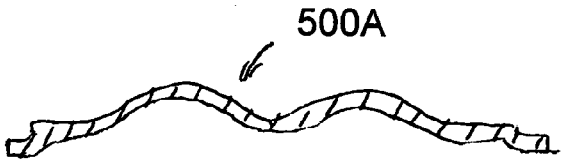
FIG. 13F is a cross sectional view taken from surface F—F of FIG. 13D.
Figure 13H:
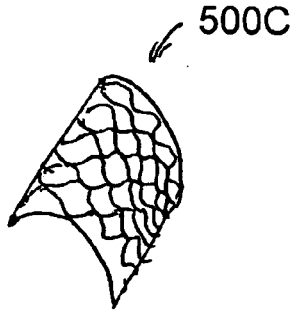
FIG. 13H is a perspective view of a tile having three dimensional contour with a textured pattern of wave shaped features that do not vary in period or amplitude.
Figure 13G:
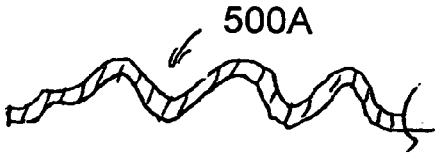
FIG. 13G is a cross sectional view taken from surface G—G of FIG. 13D.

The pattern of crests and valleys shown in FIGS. 13A, 13B and 13C can be manipulated so that the wave shape shown in FIG. 13A can increase in amplitude while decreasing in period (or wave length) progressively from the edge to the center of the tile as with tile 500A as shown in FIGS. 13D, 13E, 13F and 13G. This would result in shorter and deeper wave shaped features toward the center of tile 500A as shown in FIGS. 13E, 13F and 13G which are taken from surfaces E—E, F—F and G—G of FIG. 13D. Such a wave texture would present the illusion that tile 500A is curved toward its center. A pattern of such tiles would appear to have a regularly contoured surface as described in some of the other embodiments above. As with the patterns of oval shapes presented in FIG. 11, the wave pattern of tile 500A can be understood as a constant, regular undulating sine wave pattern laid out on a cylindrical surface as shown in FIG. 13H. The surface of tile 500A shown in FIG. 13H can be best understood as being generated by projecting the pattern of FIG. 13H onto a flat surface. The regular continuous form of a sine wave is used because it will cast patterns of shadows in a continues and natural manner. However, despite this preference, the inventor recognizes that other continues forms can be selected.

Selected portions of the wave patterned surface of tile 500 can also be selectively shaded with shaded areas 524 shown in FIG. 13. As is the case with tile 400, a tile 500 having such shading will appear darker from a lower angle such as the view angle of an observer and will also present a darker surface during winter months to lower angled sunlight thereby absorbing more heat energy in winter months. The lighter, more reflective surface of the unshaded zones will tend to reflect more vertically angled summer sunlight during hot summer months thereby reducing the absorption of unwanted heat. The same shading technique can be applied to tile 500A shown in FIG. 13D.

FIG. 14 illustrates how tile 500 can be arranged in a pattern of tiles including tiles 580, 590 and 590A. As is shown in FIG. 15, tiles 590 and 590A have an inwardly curved beak 592 for directing a concentrated stream of rain water 530 into a gutter 600 which is covered by tiles 590 and 590A. A roof covered with a pattern of tiles as shown in FIG. 14 will concentrate the flow of rain water toward the centers of those tiles and then will deliver streams of rain water into a covered cutter. Gutter 600 can be shaped in a manner corresponding to tiles 590 and 590A such that openings into gutter 600 are only available to receive concentrated streams of rain water such a stream 530 shown in FIG. 15. This would provide an enclosed gutter that would not receive debris. A side view of such an enclosed gutter is shown in FIG. 15A.

Figure 16:
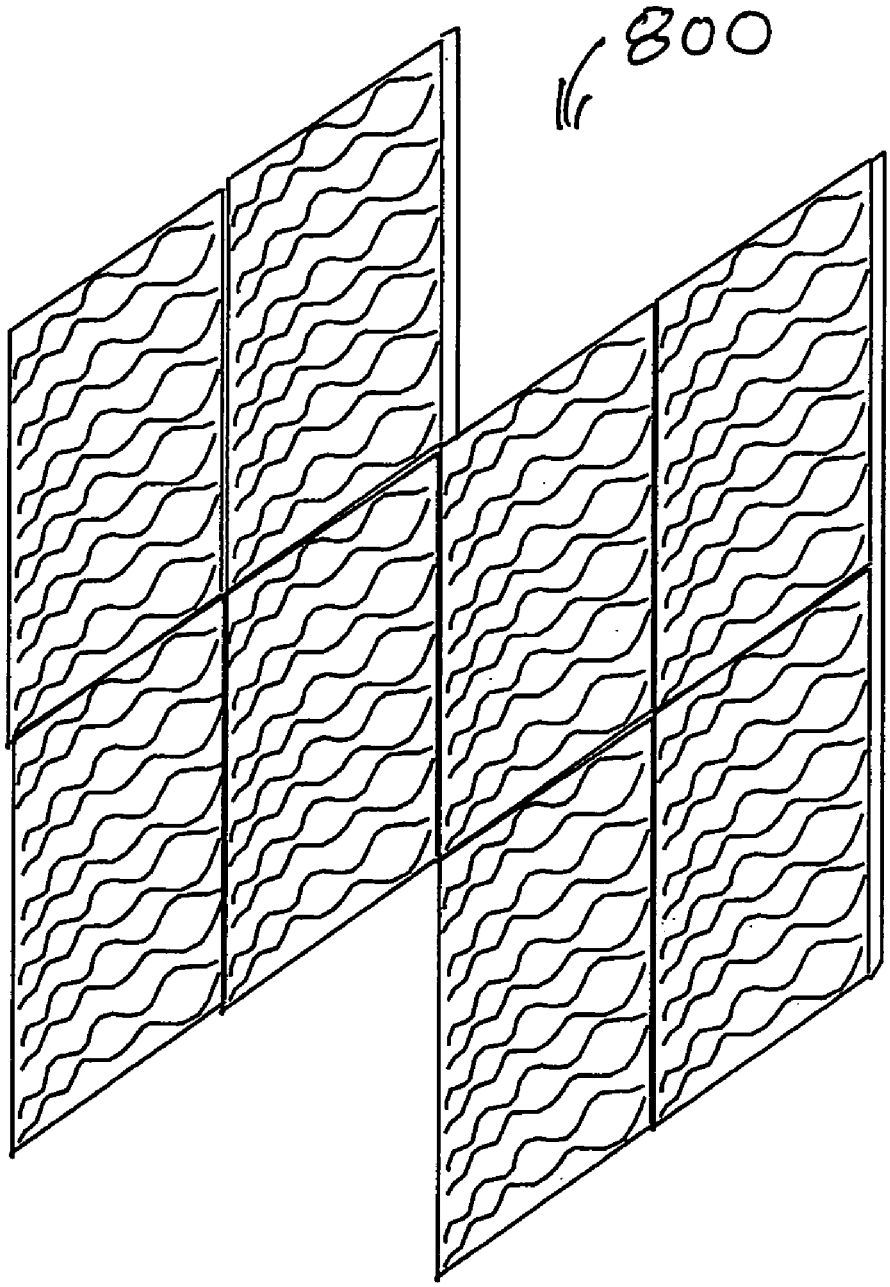
FIG. 16 is a plan view of a pattern of four roof tiles for directing rain water from a first zone of a roof to a second zone of a roof.
Figure 16A:
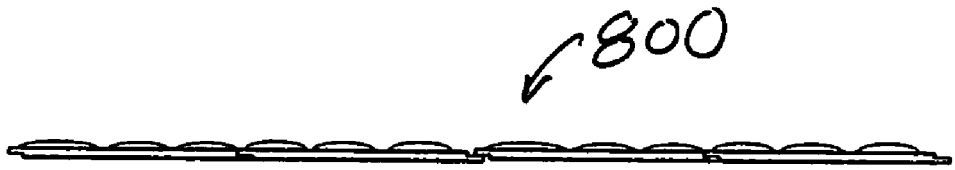
FIG. 16A is an end of the roof tiles of FIG. 16.
Figure 16C:
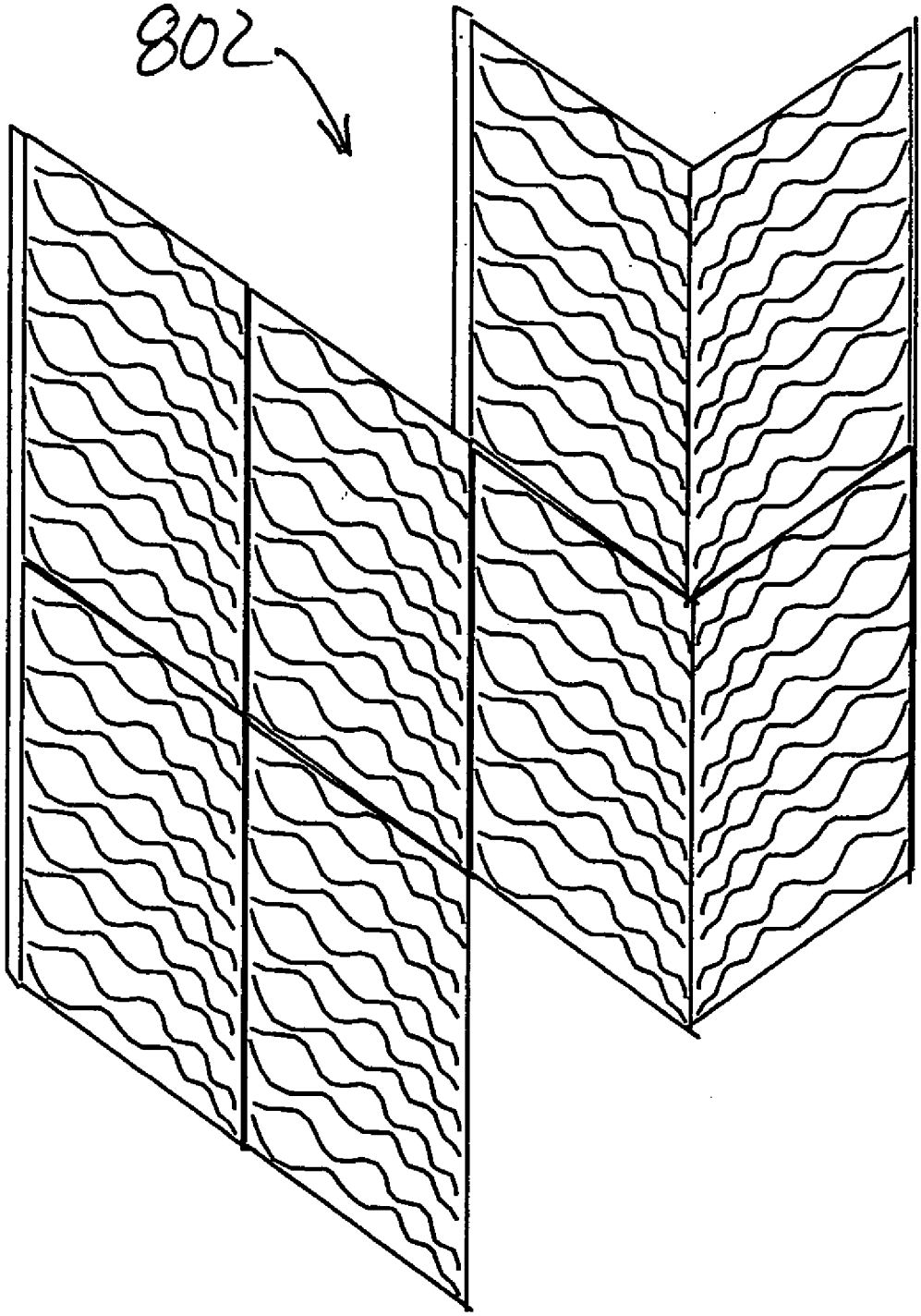
FIG. 16C is a plan view of the pattern of tiles shown in FIG. 16 with the tiles inverted to direct water in an opposite direction.

FIGS. 16 and 16A provide a plan view and an end view of a pattern of tiles 800 arranged for directing water from area A of a roof to area B of a roof. The use of a pattern of features oriented at an angle with respect to a roof grade line to direct rain water from a first area of a roof to a second area of a roof is taught in U.S. Pat. No. 6,539,683 issued to the applicant on Apr. 1, 2003 which is incorporated herein by reference. Arrow 800A gives the grade line of the roof. FIG. 16A is an end view of the tiles of FIG. 16 and illustrates that the tiles in pattern 800 are generally flat. However, as described above, these tiles include alternating crests and valleys as shown in the cross section view given in FIG. 16B. Note, that as in with the tiles described above, the tiles of FIG. 16 have a cross section of generally uniform thickness. The applicant believes that generally thin wall design of generally constant thickness decreases the weight and actually increases the strength of the tiles. A pattern of features as shown in FIG. 16 could even negate the need for guttering by directing water to a scupper at the lower edge of the roof. Further, the roof tiles of FIG. 16 may be made such that their top and bottom surfaces are generally opposite and identical so that such tiles may be installed inverted to align in an opposite direction or various directions as shown with pattern of tiles 802 in FIG. 16C.

The advantages of the textured surface shown in FIG. 13 are numerous. As noted above, such a textured surface can concentrate the flow of rain water which can then be delivered to a covered and enclosed rain gutter that is substantially impervious to gutter obstructing debris. As also noted above, such a textured surface can be shaded to present different shades from different directions. It should also be noted that various hues of colors can be applied to the textured surface described above to create colored effects. A tile having an undulating cross section as shown above with tile 300 and especially tiles 400, 500 and 500A have a greater capacity to resist pressure without cracking. Accordingly, such a tile made with a material such as the cement composite material that is often used to fabricate roof shingles or ceramic, can be made with less material and weigh less and still be strong enough to support the weight of a workman. A roof tile presenting such a surface would be easier and safer for a worker to walk on because a worker would be less likely to slip and full from such a surface. Moreover, a tile having such an undulating surface would have a greater resistance to fracturing due to hail stone impacts than a flat surfaced tile of the same thickness. Because of this, a higher degree of strength and toughness can be achieved with less material. Roof tiles that are made with less material would weigh less and therefore place less strain on underlying roof structures. An article having an undulating surface will release from a mold more easily and therefore would be easier to manufacture. Such tiles can be made of thinner material but can also be designed to stack in less volume if the patterns can be arranged to nest in a parallel fashion.

The above described embodiments accomplish the objectives of the invention by providing roof tiles that can appear to have curved surfaces while having a substantially flat form, by providing roof tiles that can direct rain water toward their centers and by providing roof tiles that are lighter, stronger and more resistant to damage than prior art roof tiles.

It is to be understood that while certain forms of this invention have been illustrated and described, it is not limited thereto, except in so far as such limitations are included in the following claims and allowable equivalents thereof.

The invention claimed is:

1. A pattern of roof tiles, comprising:

roof tiles where each roof tile includes a body having an upper surface, a lower surface, the body bounded by an upper edge and a lower edge, a first edge on one side extending between the upper and lower edges and a second opposite edge extending between the upper and lower edges, at least the upper surface having a texture which undulates in a sinusoidal fashion in two directions a first generally lateral direction extending across the roof tile between the first and second edges and a second generally longitudinal direction extending generally vertically between the upper and lower edges and wherein the lengths of the waves in the first generally lateral direction are substantially longer than the lengths of the waves in the second generally longitudinal direction, the first direction oriented such that the longer wave lengths in the lateral direction are oriented such that they are angled downwardly from the first edge to the second edge, whereby rain water draining down the surface of the roof tile will be redirected from exclusively flowing longitudinally and will also flow at least partially in a lateral direction across the roof tile.

2. The pattern of roof tiles of claim 1, wherein:

wherein the lengths of the waves in the lateral direction decrease between the first edge and the second edge to create the illusion of a curved contour between the first edge and the second edge.

3. The pattern of roof tiles of claim 1, wherein:

the pattern of waves of each tile progressively varies in depth and wave length between the first and second edges to present the illusion of a contoured surface such that the waves generally vary in a manner that is generally consistent with the appearance of wave features having constant wave length and amplitude and disposed on a contoured surface.

4. The pattern of roof tiles of claim 1, wherein:

the upper edge is replaced by a pair of opposite top edges and and the bottom edge is replaced by a pair of opposite bottom edges that generally follow parallel curves and curve downwardly from the first edge and the opposite second edge to the center of the tile, and the elongated wave features also follow a pattern of parallel curves generally parallel with the top edges and the bottom edges.

5. The pattern of roof tiles of claim 1, wherein:

the upper surfaces of the tiles have a surface texture consisting of pattern of continuous, elongated wave features and the patterns of wave features of the tiles of the pattern of roof tiles are oriented in substantially the same direction and the direction of orientation is at an angle with respect to the grade line of the roof, whereby rain water is directed to flow by the pattern of wave features at an angle with respect to the grade line of the roof from a first area of the roof to a second area of the roof.

* * * * *